United States Patent [19]

Golicz et al.

[11] 4,312,169

[45] Jan. 26, 1982

[54] MECHANISM FOR MAKING AN ENVELOPE AROUND AN INSERT

[75] Inventors: Roman M. Golicz, Clinton; William H. Gunther, Jr., Mystic; James W. Hough, Madison, all of Conn.

[73] Assignee: G.B.R., Ltd., Dover, Del.

[21] Appl. No.: 122,278

[22] Filed: Feb. 19, 1980

[51] Int. Cl.[3] ..... B65B 11/48

[52] U.S. Cl. ..... 53/206; 53/520; 53/562; 493/216; 493/921

[58] Field of Search ..... 53/206, 209, 520, 120, 53/562, 569, 464; 493/216, 921, 223, 224, 343, 349, 386, 379

[56] References Cited

U.S. PATENT DOCUMENTS

| | | | |
|---|---|---|---|
| 3,808,768 | 5/1974 | Dobbs | 53/206 X |
| 4,071,997 | 2/1978 | Gunther, Jr. et al. | 53/206 X |
| 4,189,895 | 2/1980 | Volkert et al. | 53/206 X |
| 4,202,150 | 5/1980 | Petersson | 53/206 |
| 4,205,504 | 6/1980 | Gregoire et al. | 53/206 X |

*Primary Examiner*—James F. Coan

*Attorney, Agent, or Firm*—Holland, Armstrong, Wilkie & Previto

[57] ABSTRACT

An improved machine and method of making and folding an insert and a personalized envelope therefor.

20 Claims, 4 Drawing Figures

Fig. 1.
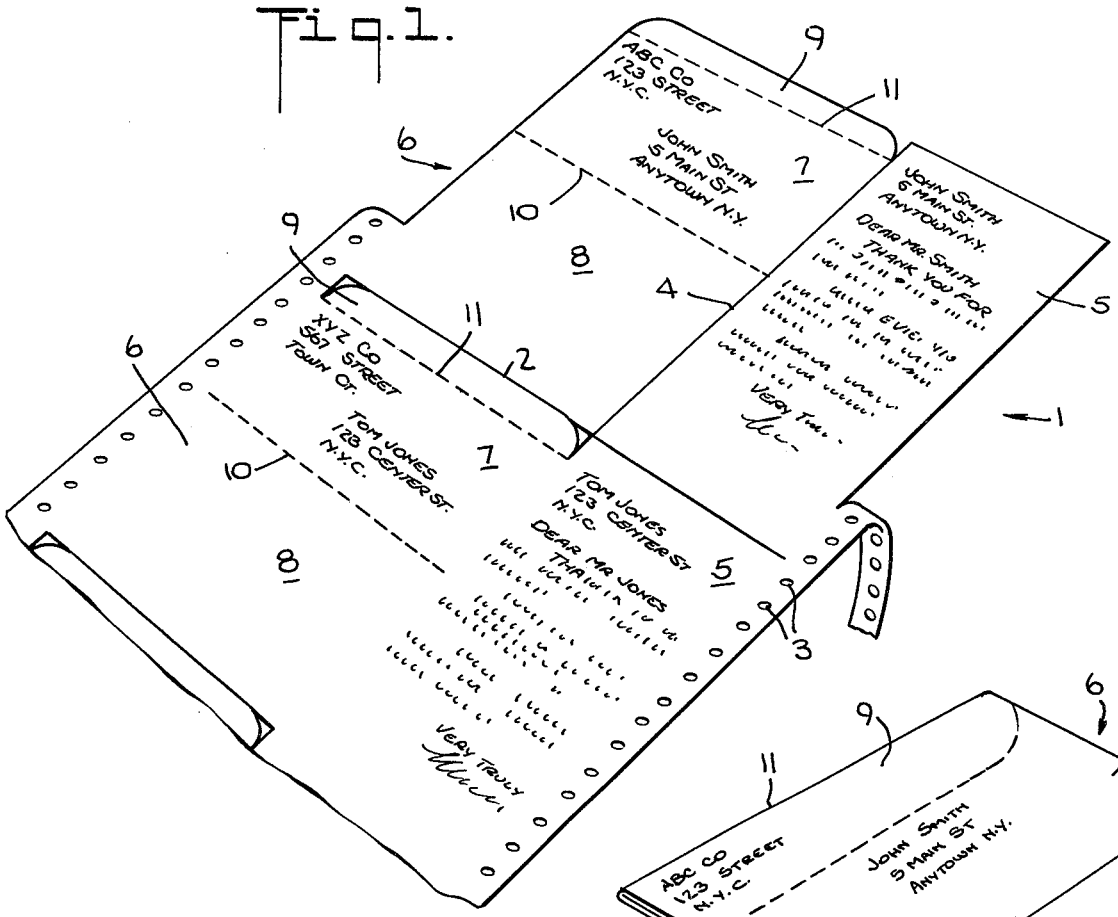
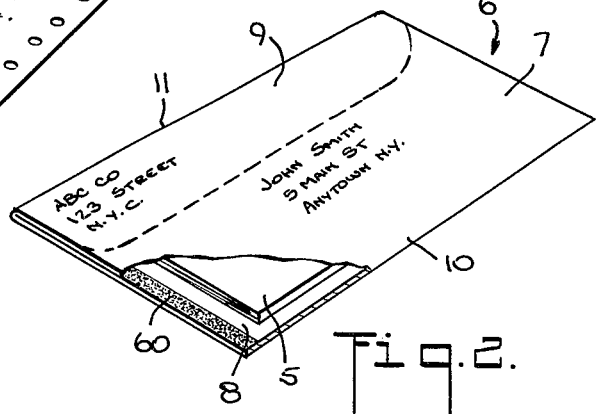
Fig. 2.
Fig. 4.
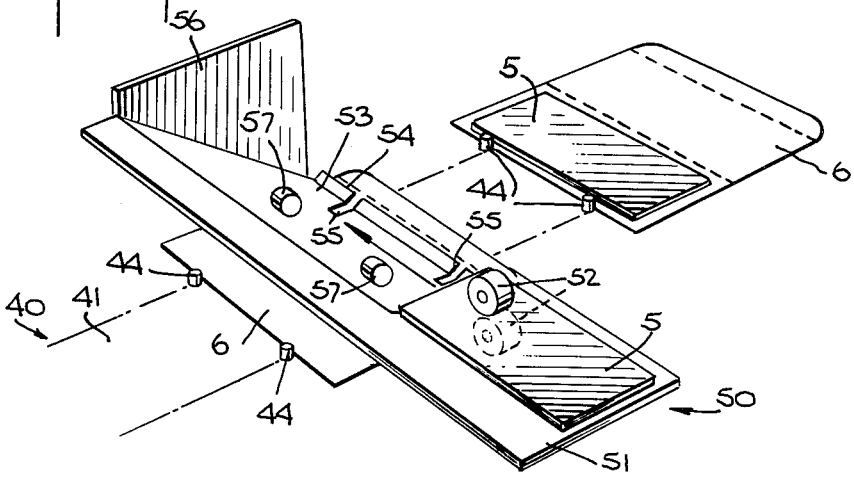

MECHANISM FOR MAKING AN ENVELOPE AROUND AN INSERT

The present invention is directed to an improved method and mechanism of making and folding an envelope and more particularly to an improved mechanism and method of making and folding an envelope around an insert, such as a personalized letter, to form a personalized envelope.

In various promotions, such as solicitations for subscribers, funds, etc. it is desirable for the envelope and the insert, or other message enclosed within the envelope, to be personalized.

Even if the insert and envelope are both automatically printed by a computer, it is an expensive and a time-consuming operation to stuff the insert into the corresponding envelope and to seal it.

Present machinery and methods do not provide for automatic printing of personalized letters and envelopes and insertion of one into the other and for automatic wrapping of envelopes around the letter inserts.

The present invention overcomes these difficulties and has for one of its objects the provision of an improved mechanism and method which will automatically stuff an insert into an envelope, and which will automatically seal the contents within the envelope.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 1 is a perspective view of a continuous sheet or web having thereon inserts and letters in the nature of a personalized printed envelope and a personalized letter which is to be positioned within the envelope.

FIG. 2 is a perspective view of the sealed envelope with the insert therein.

FIG. 3 is a schematic diagrammatic view of the operation of this present invention.

FIG. 4 shows a detail of a portion of the present invention.

Figure 9:
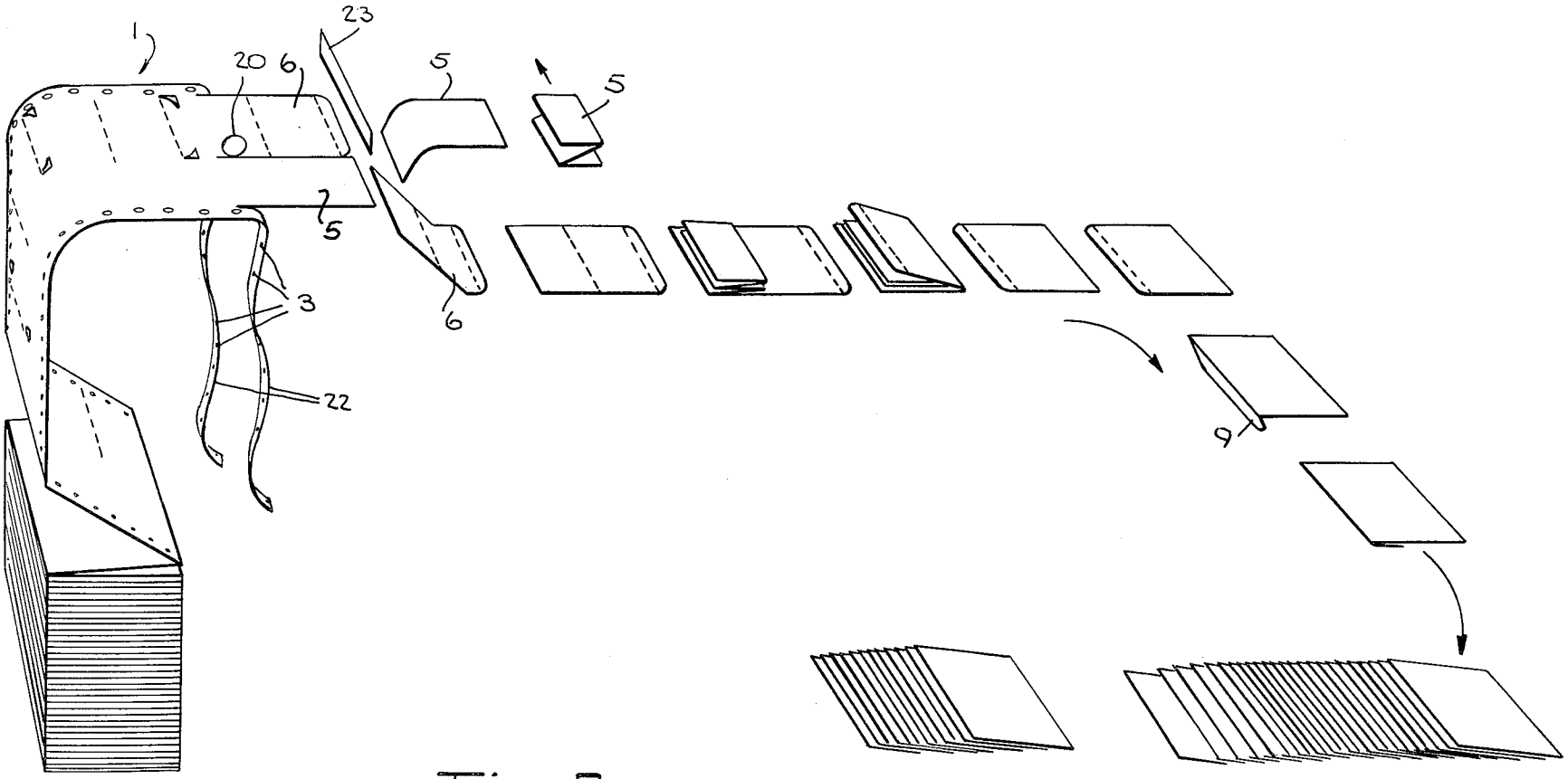

Referring more particularly to the drawings, the web 1 from which the envelope and the letter is made is shown in FIG. 1 and comprises a continuous composite sheet having a series of openings 3 along each side to accommodate pins of a sprocket type feed mechanism (not shown). The web may be stored in a roll or in a fan fold, as may be desired.

The composite sheet is divided by transverse and longitudinally cut lines 2 and 4, respectively, (which may be perforations) into a plurality longitudinal of insert assemblies 5 and a plurality of longitudinal located envelope assemblies 6. The two assemblies 5 and 6 are transversely located relative to each other by the longitudinal cut line 4.

Each letter or insert assembly 5 may have a message and a personalized address thereon. Each envelope assembly 6 has a front panel 7 which has a personalized address, which corresponds to the personalized address on the letter assembly 5 it is attached to, as well as a return address. Each envelope 6 has a rear panel 8 attached to a front panel 7 by a fold line 10 and flap 9 attached by fold line 11 to the front panel 7. The fold lines 10 of each envelope 6 are coextensive with each other and the fold lines 11 thereof are also coextensive with each other.

In general, the method and mechanism of the present invention comprises detaching the envelope assembly 6 from insert assembly 5 along cut line 4 and folding letter assembly 5. The folded insert assembly 5 (as well as any other inserts) are placed on the rear panel 8 of the envelope 6. The front panel 7 is then folded over the insert assembly 5 along fold 10 and the edges sealed and the flap 9 is folded over and adhered to the rear panel 8 to complete the envelope. The tractor holes 3 are preferably removed before any of the other steps are performed.

The envelope assembly 6 is deflected downwardly and delivered to a moving first conveyor means 40. The insert assembly 5 is deflected upwardly to a folding, slitting and trimming mechanism (not shown) which folds the insert assembly 5, and delivers the insert 5 onto the envelope assembly 6 which is moving with the conveyor assembly means 40.

At the appropriate time, the leading edge of each envelope assembly 6 is folded over the previously deposited folded insert 5 by suitable folding assembly (not shown). Simultaneously, the end areas are adhered together to seal the end edges thereof.

After discharge from the first conveyor assembly means 41, the envelope 6 is placed on a moving second conveyor assembly means (not shown) where the flap 9 is folded over the rear panel and sealed thereto to complete the envelope.

The continuous web 1 is preferably fed from a fan fold storage area (not shown). However, the web 1 can also be fed from a roll, if desired. It is also within the purview of the present invention that the machine may operate with a previously separated letter assembly and envelope assembly.

The web 1 is first moved past a pair of side knife means (not shown) which remove the edge strips 22 which have the feed holes 3 therein. The web 1 is then moved over a central cutting assembly means 20, which cuts the web 1 and separates the insert assembly 6 from the envelope assembly 5. The cutter means 23 cuts the web transversely to separate longitudinally located inserts 5 and envelopes 6 from each other.

Immediately in back of the cutter assembly 23 is a deflecting mechanism which is adapted to deflect the envelope assembly 6 downwardly onto conveyor means 41. Means are also provided to move the insert assemby 5 upwardly for insertion in a folding assembly.

The conveyor means 40 comprise a continuously moving conveyor 41 which may be driven by a wheel and chain assembly (not shown). The conveyor 41 has a plurality of transversely located upwardly extending longitudinally spaced drive pins 44. A pair of drive pins 44 are located on each side of the center line of the conveyor 41. When the envelope assemblies 6 are deposited onto the conveyor 41, the pins 44 strike the rear edge of the envelope assembly 6, to move it along with the conveyor 41. The pins 44 are adapted not only to strike and move the envelope assembly 6 but also to cause the letter assemblies 5 to be deposited onto the envelope assembly and to move the envelope assembly 6, and the letter assembly 5 along.

The folding mechanism which folds the letter assembly 5 before it is deposited onto the envelope assembly 6 may be any well known mechanism, which will fold the letter assembly 5 in two or more folds, for example, a mechanism similar to the one shown in U.S. Pat. No. 1,879,990. This will fold the letter assembly 5 in two or more folds depending on the particular type of folding desired. The folding mechanism is a standard folding mechanism and, hence, will not be described in greater detail.

After the letter assembly 5 is folded, it is moved onto a transfer mechanism 50 which moves the letter assembly in a horizontally transverse direction from a position adjacent the path of the envelope assembly 6 to a position overlying the path of the envelope assembly 6. The mechanism may comprise a platform 51 and feed rollers 52 to grasp the letter assembly 5 and move it over to a position overlying the path of the envelope assembly 6.

An inclined chute 53 overlies the conveyor 41, and terminates in a horizontal toe 54. The letter assembly 5 is moved by rollers 52 to the chute 53 so that it slides down the chute 53 until it rests on the toe 54. Rollers 57 may be used to push the letters downwardly, if desired. The toe 54 is positioned in close adjacency over the conveyor 41 and is substantially parallel to the conveyor 41. The chute 53 has a longitudinal slit 55 therein to permit the pins 44 of the conveyor to move therethrough. Guide rails 56 are provided to prevent the sliding of letter assembly 5 from angling when sliding down chute 53.

With the letter assembly 5 resting on toe 54, the pins 44 which are moving the envelope assembly 6 forward, move through the slits 55 and strike the rear edge of the folded letter assembly 5 so as to move it off toe 54 and deposit it on their corresponding personalized envelope assembly 6. Since the letter assembly is moving at about the same speed and the envelope assembly 6, chute 54 allows letters to move down to toe 54 at least as quickly as it takes the envelopes to be positioned below toes 54 so that each personalized letter assembly 5 will be deposited on its respective personalized envelope assembly 6.

The envelope assembly 6 with letter assembly 5 thereon may then be moved by pins 44 beneath an additional insert depositing assembly (not shown) where additional inserts may be deposited, if desired.

The combination may then be moved by pins 44 beneath an adhesive applicator (not shown) which applies adhesive 60 to the envelope assembly 6. The adhesive applicator may be any conventional type of applicator, such as a sprayer, a roller, or a spotter. However, a pre-gummed envelope may also be used if desired.

The combination is then moved to an envelope wrapping assembly (not shown) which folds the envelope.

The folded and edge sealed envelope assembly 6 is then moved onto a second conveyor (not shown) which is at an angle (preferably at a right angle) to the first conveyor 41. The second conveyor moves the envelopes past a flap folding mechanism (not shown) which folds the flap 9 as each envelope moves past it. An adhesive is applied to flap 9 by a suitable applicator as the envelope assembly 6 moves past it. The envelope assembly 6 is then moved past a suitable pressure roller which seals flap 9 and is then moved off the conveyor.

Hence, the present invention provides a machine and method which will automatically stuff a personalized letter into a personalized envelope, which permits additional inserts to be added to the envelope and which automatically seals the contents.

Furthermore, the present invention permits the envelope blank to have an adhesive applied to it automatically before the folding operation.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privelege is claimed are defined as follows:

1. A mechanism for forming an envelope, comprising a composite sheet which includes a predetermined envelope assembly and a predetermined letter insert assembly connected together in adjacent transverse relationship to each other, means for moving said composite sheet in a lengthwise direction, means for severing said composite sheet lengthwise between said letter insert assembly and said envelope assembly, means for severing said composite sheet transversely to separate the two assemblies into individual and separate letter and envelope assemblies, means for moving the said individual envelope assembly along one path and for moving the said individual letter insert assembly along another path, means for relative positioning of the said predetermined letter insert assembly in superimposed relationship to the said predetermined envelope assembly, said means for moving said envelope assembly including means for causing said letter insert assembly to be deposited on top of said moving envelope assembly, means for folding said envelope assembly around said letter insert assembly and means for sealing the edges of said envelope assembly.

2. A mechanism as claimed in claim 1 wherein the paths of said insert assembly and said envelope assembly are in superimposed relationship to each other.

3. A mechanism as claimed in claim 2 wherein means are provided for deflecting said insert assembly and said envelope assembly in opposite directions for deposition of each on the respective moving means.

4. A mechanism as claimed in claim 3 wherein means are provided for moving one of said assemblies transversely to be superimposed over the other assembly.

5. A mechanism as claimed in claim 4 wherein said letter assembly is moved transversely.

6. A mechanism as claimed in claim 5 wherein said moving means comprises rollers to grasp the envelope assembly and move it transversely.

7. A mechanism as claimed in claim 6 wherein said letter insert assembly moving means comprises a slide chute overlying the conveyor means down which the letter insert assembly slides, said slide chute having a lower toe overlying the conveyor means.

8. A mechanism as claimed in claim 7 wherein said rollers are located at the top of said chute.

9. A mechanism as claimed in claim 8 wherein said envelope assembly moving means comprises conveyor means having upstanding pins adapted to strike the envelope assembly.

10. A mechanism as claimed in claim 9 wherein slits are provided in said slide chute to permit the pins to strike the letter assembly and push it off the toe and onto the envelope assembly.

11. A mechanism as claimed in claim 10 wherein a folding machine is provided adjacent to the upper edge of said slide chute to fold the letter insert assembly.

12. A mechanism as claimed in claim 11 wherein means are provided for applying adhesive to the edges of the envelope assembly.

13. A mechanism as claimed in claim 12 wherein pressure applying means are provided to seal the edges of the folded envelope assembly.

14. A mechanism as claimed in claim 13 wherein means are provided for transferring said folded envelope assembly to a flap folding means.

15. A mechanism as claimed in claim 14 wherein said flap folding means comprises second conveyor means moving at an angle to said first conveyor means.

16. A mechanism as claimed in claim 15 wherein adhesive is applied to the envelope flap, means are provided to turn the flap and a pressure means are provided to seal the flap.

17. A mechanism as claimed in claim 16 wherein said envelope assembly and said letter insert assembly are on a continuous web and wherein cutter means are provided in advance to said deflecting means to separate the letter insert assembly from the envelope assembly.

18. A mechanism as claimed in claim 17 wherein a cutter is provided to cut the web along the center, to separate the letter assembly from the envelope assembly.

19. A mechanism as claimed in claim 18 wherein guides are provided on the chute to prevent the letter insert assembly from angling.

20. A mechanism as claimed in claim 19 wherein an adhesive applicator applies adhesive to the edges of the envelope assembly to seal them.

* * * * *